US007867377B2

(12) United States Patent
Clark et al.

(10) Patent No.: US 7,867,377 B2
(45) Date of Patent: Jan. 11, 2011

(54) FUEL COMPOSITION

(75) Inventors: Richard Hugh Clark, Chester (GB); Richard John Heins, Chester (GB); Robert Wilfred Matthews Wardle, Chester (GB)

(73) Assignee: Shell Oil Company, Houston, TX (US)

( * ) Notice: Subject to any disclaimer, the term of this patent is extended or adjusted under 35 U.S.C. 154(b) by 421 days.

(21) Appl. No.: 11/614,118

(22) Filed: Dec. 21, 2006

(65) Prior Publication Data

US 2007/0205137 A1 Sep. 6, 2007

(30) Foreign Application Priority Data

Dec. 22, 2005 (EP) ..... 05112840

(51) Int. Cl.
*C10L 1/04* (2006.01)
*C10L 1/06* (2006.01)

(52) U.S. Cl. ..... 208/15; 208/16; 208/17; 585/14; 44/300

(58) Field of Classification Search ..... 208/15
See application file for complete search history.

(56) References Cited

U.S. PATENT DOCUMENTS

| | | | | |
|---|---|---|---|---|
| 4,208,190 | A | 6/1980 | Malec | 44/53 |
| 6,180,842 | B1 * | 1/2001 | Berlowitz et al. | 585/1 |
| 6,755,961 | B1 * | 6/2004 | Berlowitz et al. | 208/15 |
| 6,776,897 | B2 * | 8/2004 | Bacha et al. | 208/14 |
| 7,033,484 | B2 * | 4/2006 | Bacha et al. | 208/14 |
| 7,285,693 | B2 * | 10/2007 | Clark | 585/1 |
| 7,345,210 | B2 * | 3/2008 | Maund et al. | 585/14 |
| 7,390,397 | B2 * | 6/2008 | Lamprecht et al. | 208/308 |
| 7,404,888 | B2 * | 7/2008 | O'Rear et al. | 208/17 |
| 2003/0098261 | A1 | 5/2003 | Bacha et al. | 208/170 |
| 2005/0109672 | A1 * | 5/2005 | Bauldreay et al. | 208/15 |
| 2005/0288537 | A1 * | 12/2005 | Maund et al. | 585/14 |
| 2007/0021636 | A1 * | 1/2007 | Bosch | 585/14 |
| 2008/0282603 | A1 * | 11/2008 | Clark et al. | 44/300 |

FOREIGN PATENT DOCUMENTS

| | | |
|---|---|---|
| EP | 147873 | 7/1985 |
| EP | 583836 | 2/1994 |
| GB | 2077289 | 12/1981 |
| WO | 01/83648 | 11/2001 |
| WO | 03/087273 | 10/2003 |
| WO | WO2004104142 | 12/2004 |

OTHER PUBLICATIONS

P.J. Schoenmakers, J.L.M.M. Oomen, J. Blomberg, W. Genuit, G. van Velzen, J. Chromatogr. A, 892 (2000) p. 29.

* cited by examiner

*Primary Examiner*—Ellen M McAvoy

(57) ABSTRACT

A composition having a density at 15° C. of between 820 and 845 kg/m$^3$ and a cetane number of equal or greater than 40, which composition has been obtained by blending the following components: (a) a cracked gas oil, (b) a mineral derived gas oil other than (a), and (c) a Fischer-Tropsch derived kerosene fraction; and the use of this composition as an automotive gas oil fuel composition.

40 Claims, No Drawings

FUEL COMPOSITION

FIELD OF THE INVENTION

The present invention relates to a composition suitable as a fuel composition, particularly a blended gas oil fuel composition.

BACKGROUND OF THE INVENTION

Over the past years there have been increasing environmental pressures that have resulted in ever-tightening automotive diesel specifications around the world and especially in Europe and the USA. A key driver in this respect is the need for more stringent emissions legislation to improve air quality. This has resulted in automotive gas oil (diesel) specifications involving higher cetane numbers and lower densities.

SUMMARY OF THE INVENTION

A composition is provided having a density at 15° C. of between 820 and 845 kg/m$^3$ and a cetane number of equal or greater than 40, which composition is produced by blending the following components:

(a) a cracked gas oil, (b) a mineral derived gas oil other than (a), and (c) a Fischer-Tropsch derived kerosene fraction.

An automotive gas oil fuel comprising such composition in admixture with one or more fuel additives is also provided.

DETAILED DESCRIPTION OF THE INVENTION

Cetane numbers can be measured either by the standard test method IP 498 or ASTM D6890, or by the standard test method IP 41 or ASTM D613.

An example of a process which prepares a cracked gas oil is the fluidized catalytic cracking (FCC) of heavy hydrocarbons. FCC processes have been around since the 1940s. Typically, an FCC unit or process includes a riser reactor, a catalyst separator and stripper, and a regenerator. A FCC feedstock is introduced into the riser reactor wherein it is contacted with hot FCC catalyst from the regenerator. The mixture of the feedstock and FCC catalyst passes through the riser reactor and into the catalyst separator wherein the cracked product is separated from the FCC catalyst. The separated cracked product passes from the catalyst separator to a downstream separation system and the separated catalyst passes to the regenerator where the coke deposited on the FCC catalyst during the cracking reaction is burned off the catalyst to provide a regenerated catalyst. The resulting regenerated catalyst is used as the aforementioned hot FCC catalyst and is mixed with the FCC feedstock that is introduced into the riser reactor.

FCC processes and systems are designed so as to provide for a high conversion of the FCC feedstock to products having boiling temperatures in the gasoline boiling range. As a by-product of the FCC process products boiling in the gas oil boiling range are produced. These products typically have a high density and a low cetane number. The quality of these cracked gas oil products is typically not good enough to be used directly in an automotive gas oil fuel product. In a refinery environment comprising a FCC process the cracked gas oil obtained in said process will thus have to be blended with other refinery streams in order to meet the aforementioned stringent specifications directed to higher cetane numbers and lower densities.

Typically in a refinery, where the main feed is crude mineral oil, the refinery scheduler has at his disposal low sulphur gas oil fractions, which will have a good cetane number and a lower density. Additionally the refinery scheduler may add a refinery kerosene fraction, sometimes also referred to as a light gas oil fraction, i.e. a gas oil with a low end boiling point or low T95 vol % recovery point. The addition of said lower density fractions will obviously lower the density of the resultant blend.

It has been found that it is possible to arrive at a blend having the desired cetane number and density by blending a mineral derived gas oil and a mineral derived kerosene product with the cracked gas oil. However, when the volume percentage of the cracked gas oil increases, for example to values of above 10 vol %, it became very difficult and even impossible to make a blended product having the desired density and cetane number.

It would be highly desirable for the refinery scheduler to be able to blend in more of the cracked gas oil fractions as obtained, for example as a by-product of the FCC process, in a final product, which is suited for use as automotive gas oil. Alternatively, but less desirable, the refinery scheduler can blend the cracked gas oil into a lower value product such as for example industrial gas oil. Industrial gas oil may be used as domestic heating fuel.

The present invention makes it possible to use more of the cracked gas oil in a blend suited for use in an automotive gas oil fuel.

In accordance with the present invention there is provided a composition having a density at 15° C. of between 820 and 845 kg/m$^3$ and a cetane number of equal or greater than 40, which composition has been obtained by blending the following components:

(a) a cracked gas oil, (b) a mineral derived gas oil other than (a), and (c) a Fischer-Tropsch derived kerosene fraction.

It has been found that by using a Fischer-Tropsch derived kerosene fraction instead of a refinery kerosene fraction more cracked gas oil can be part of the blend having the specified density and cetane number properties. It has been found that Fischer-Tropsch derived kerosene also has a higher cetane number than component (a) and even component (b) of the blend. In addition to this difference, the Fischer-Tropsch kerosene is also more volatile. These two properties combined have additionally been found to result in a better combustion process. Better combustion can in turn be manifested in improved acceleration times for a vehicle running on the relevant fuel composition. Thus, not only does the present invention provide the possibility to blend in more cracked gas oil, but it may also provide an improved fuel.

An additional advantage is that the lower boiling components and thus the most volatile components in the blend consist mainly of paraffins. This is in contrast to when a refinery kerosene would be used, which also comprises other compounds such as aromatics. The presence of paraffins is advantageous because such paraffin compounds incur less odor, which makes the final fuel product more attractive. The presence of paraffins in the lower boiling range of the final blend is also a distinguishing feature of the novel blend. One will notice a high paraffin content in the fraction boiling between 150 and 180° C. for the blended compositions according the present invention relative to blended compositions made up of exclusively refinery fractions.

The composition according to the present invention is suitable for use as an automotive gas oil fuel composition. Such a fuel composition will comply with applicable local and current standard specifications, for example EN590:2004 in Europe. The fuel will suitably have a T95 of between 275 and 360° C., a density of between 820 and 845 kg/m$^3$ at 15° C. (ASTM D4502), a flash point of above 55° C., a cetane number of above 40, more preferably above 45, even more preferably above 48 and most preferably above 51, as measured by IP 498 [IQT], and a kinematic viscosity at 40° C. of between 2 and 4.5 mm$^2$/s (cSt). The CFPP (cold filter plugging point) of the fuel is dependent on the climate in the area of usage, for example in EU below +5° C. in warmer regions and below −20° C. in the colder regions. The CFPP requirements will also depend on the season. For example, the maximum CFPP in winter may be −15° C., while for the same region the maximum CFPP in summer may be −5° C. Preferably, the CFPP is between −10 and −5° C. The aromatic content of the fuel is suitably between 0 and 40 wt %. The sulphur content of the fuel is suitably less than 1000 ppmw, preferably less than 350 ppmw, even more preferably less than 50 ppmw and most preferably less than 10 ppmw when the fuel has to comply with the more stringent European and US specifications.

Component (a) is a cracked gas oil. Cracked gas oils are the gas oil fractions obtained in any process, thermal or catalytic, which is operated in the absence of added hydrogen. Such processes are sometimes referred to as carbon rejection processes. Examples of such processes are the earlier referred to FCC process and thermal cracking and vis-breaking processes, which are all well known refinery processes. Cracked gas oils are characterized in that they cannot be qualified as automotive gas oil fuel if used as the only gas oil component. More especially, the cracked gas oils will have a density at 15° C. of greater than 845 kg/m$^3$ and/or a cetane number of less than 51. The present invention is especially suited for cracked gas oils which have a density at 15° C. of greater than 845 kg/m$^3$, more especially greater than 860 kg/m$^3$, and a cetane number of less than 51, more especially less than 45. The upper limit for the density at 15° C. of the cracked gas oil is typically 920 kg/m$^3$ and the lower limit for the cetane number of the cracked gas oil is typically 25.

Component (a) is preferably subjected to a hydrodesulphurization process in order to reduce the sulphur content to a value of below 1000 ppmw, more preferably to a value of below 500 ppmw and even more preferably below 100 ppmw. Such processes are suited to reduce the sulphur level but will not reduce the high content of aromatics and polyaromatics sufficiently to improve the density sufficiently to a value below that referred to above. Preferably, a hydrodesulphurized cracked gas oil, sometimes referred to as a hydrotreated light cycle oil (LCCO), as obtained in a FCC process and having the above properties, is used.

Component (b) is a gas oil fraction obtained from a mineral crude source, as for component (a), but which in contrast has not been obtained in a carbon rejection process. Examples of such gas oil fractions are straight run gas oil, vacuum gas oil and gas oil fractions as obtained in a hydrocracker unit. As for component (a), component (b) will also be subjected to a desulphurization process in order to reduce the sulphur content to a value of below 1000 ppmw and more preferably to a value of below 500 ppmw, if so required. Gas oil component (b) may suitably be a low sulphur or even a zero sulphur gas oil, which may be produced in a modern refinery, having a sulphur content of below 50 ppmw and even below 10 ppmw. Component (b) will typically have boiling points within the usual diesel range of 150 to 400° C. Component (b) will typically have a density at 15° C. of from 750 to 900 kg/m$^3$, preferably from 800 to 860 kg/m$^3$, and even more preferably from 820 to 845 kg/m$^3$ at 15° C. and a cetane number of from 45 to 80, more preferably from 51 to 75. It will typically have an initial boiling point in the range 150 to 230° C. and a final boiling point in the range 290 to 400° C. Its kinematic viscosity at 40° C. (ASTM D445) might suitably be from 1.5 to 4.5 mm$^2$/s (centistokes).

Component (c) is a Fischer-Tropsch derived kerosene fraction. By "Fischer-Tropsch derived" it is meant that a fuel is, or derives from, a synthesis product of a Fischer-Tropsch condensation process. A Fischer-Tropsch derived fuel may also be referred to as a GTL (Gas-to-Liquids) fuel.

The Fischer-Tropsch reaction converts carbon monoxide and hydrogen into longer chain, usually paraffinic, hydrocarbons:

$$n(CO+2H_2)=(—CH_2—)_n+nH_2O+\text{heat}$$

in the presence of an appropriate catalyst and typically at elevated temperatures, for example 125 to 300° C., preferably 175 to 250° C., and/or pressures, for example 5 to 100 bar, preferably 12 to 80 bar. Hydrogen:carbon monoxide ratios other than 2:1 may be employed if desired.

The carbon monoxide and hydrogen may themselves be derived from organic or inorganic, natural or synthetic sources, typically from coal, biomass, for example wood chips, residual fuel fractions or more preferably natural gas or from organically derived methane.

The Fischer-Tropsch derived kerosene fraction may be obtained directly from the Fischer-Tropsch reaction, or indirectly, for instance by fractionation of Fischer-Tropsch synthesis products or from hydrotreated Fischer-Tropsch synthesis products. Hydrotreatment can involve hydrocracking to adjust the boiling range, as for example described in GB-B-2077289 and EP-A-0147873, and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired kerosene fraction(s) may subsequently be isolated for instance by distillation.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836. The Fischer-Tropsch reactor may be, for example, a multi-tubular reactor or a slurry reactor.

An example of a Fischer-Tropsch based process is the SMDS (Shell Middle Distillate Synthesis). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax, which can then be hydroconverted and fractionated to produce liquid transport fuels such as the kerosene fractions according the present invention. A version of the SMDS process, utilizing a fixed bed reactor for the catalytic conversion step, is currently in use in Bintulu, Malaysia. Kerosene fractions prepared by the SMDS process are commercially available for instance from Shell companies.

By virtue of the Fischer-Tropsch process, a Fischer-Tropsch derived kerosene fraction has essentially no, or undetectable levels of, sulphur and nitrogen. Compounds containing these heteroatoms tend to act as poisons for Fischer-Tropsch catalysts and are therefore removed from the synthesis gas feed. This can yield additional benefits, in terms of effect on catalyst performance, in fuel compositions in accordance with the present invention.

Further, the Fischer-Tropsch process as usually operated produces no or virtually no aromatic components. The aromatics content of a Fischer-Tropsch derived fuel, suitably determined by ASTM D4629, will typically be below 1% w/w, preferably below 0.5% w/w and more preferably below 0.1% w/w.

Generally speaking, Fischer-Tropsch derived kerosene fractions have relatively low levels of polar components, in particular polar surfactants, for instance compared to petroleum derived fuels. It is believed that this can contribute to improved antifoaming and dehazing performance in the final automotive gas oil fuel. Such polar components may include for example oxygenates, and sulphur and nitrogen containing compounds. A low level of sulphur in a Fischer-Tropsch derived fuel is generally indicative of low levels of both oxygenates and nitrogen-containing compounds, since all are removed by the same treatment processes.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C. Again, Fischer-Tropsch derived kerosenes tend to be low in undesirable fuel components such as sulphur, nitrogen and aromatics. The Fischer-Tropsch kerosene will suitably have a paraffin content of between 90 and 100 wt %, more especially between 98 and 100 wt %.

A Fischer-Tropsch derived kerosene fuel preferably has a density of from 730 to 760 kg/m$^3$ at 15° C., for instance from 730 to 745 kg/m$^3$ for a narrow-cut fraction and from 735 to 760 kg/m$^3$ for a full-cut fraction. It preferably has a sulphur content of 5 ppmw (parts per million by weight) or less. In particular, it has a cetane number of from 63 to 75, for example from 65 to 69 for a narrow-cut fraction, and from 68 to 73 for a full cut fraction.

The iso to normal ratio of component (c) may range from 0.3 to 5 and is preferably greater than 2.5 and more preferably greater than 3. The higher iso to normal ratio kerosene products are suitably obtained by hydrotreating, preferably hydroisomerisation, of the Fischer-Tropsch wax.

The iso to normal ratio and the paraffin content of the blending components in the context of the present invention are measured by means of comprehensive multi-dimensional gas chromatography (GCxGC), as described in P. J. Schoenmakers, J. L. M. M. Oomen, J. Blomberg, W. Genuit, G. van Velzen, J. Chromatogr. A, 892 (2000) p. 29 and further.

The preferred blend will comprise between 5 and 60 vol % of cracked gas oil component (a), more preferably between 15 and 35 vol % of cracked gas oil. Preferably, the blend will comprise more than 5 vol %, preferably more than 10 vol % and even more preferably more than 15 vol % of the Fischer-Tropsch kerosene component (c). The upper limit will depend in part on the density of the cracked gas oil. Preferably the blend comprises less than 50 vol %, more preferably less than 40 vol % of the Fischer-Tropsch derived kerosene. The balance is made up of gas oil component (b).

The blend is preferably used as an automotive gas oil fuel composition. The fuel composition itself may be additised (additive-containing) or unadditised (additive-free). If the fuel composition is additised, it will contain minor amounts of one or more additives, e.g. one or more detergent additives. Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

The additive may contain other components in addition to the detergent. Examples are lubricity enhancers (e.g. ester- and acid-based additives); dehazers (e.g. alkoxylated phenol formaldehyde polymers); anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; and combustion improvers.

The additive concentration of each such additional component in the additivated fuel composition is preferably up to 1% w/w, more preferably in the range from 5 to 1000 ppmw, advantageously from 75 to 300 ppmw, such as from 95 to 150 ppmw.

The present invention will now be illustrated by the following example.

COMPARATIVE EXPERIMENT

In this blending study, typical components that are used to make finished automotive gas oil products, namely a UK Ultra Low Sulphur Diesel (HDS), a Light Gas Oil (LGO; refinery kerosene) and a Hydrotreated Light Cycle Oil (HLCCO) as obtained in a FCC process are combined in different proportions, as shown in Table 1. The resultant cetane number, density and CFPP are provided in Table 1. Table 1 also notes the fuel requirements, which make the blend suited for use as Automotive Gas Oil.

TABLE 1

| HLCCO | LGO | HDS | Cetane number (*) | Density at 15° C. (kg/m$^3$) | CFPP (° C.) |
|---|---|---|---|---|---|
| 100% | | | 38.4 | 892.7 | −2 |
| | 100% | | 42 | 802 | −50 |
| | | 100% | 54.7 | 835.6 | −5 |
| Blend composition (vol %) | | | Calculated blend properties | | |
| 15 | 0 | 85 | 52.3 | 844.2 | −5 |
| 12 | 25 | 60 | 49.1 | 835.8 | −8 |
| 20 | 5 | 75 | 50.8 | 845.3 | −5 |
| 20 | 25 | 55 | 48.3 | 838.6 | −8 |
| 25 | 10 | 65 | 49.4 | 846.5 | −5 |

TABLE 1-continued

| HLCCO | LGO | HDS | Cetane number (*) | Density at 15° C. (kg/m$^3$) | CFPP (° C.) |
|---|---|---|---|---|---|
| 25 | 30 | 45 | 46.8 | 839.8 | −8 |
| 30 | 15 | 55 | 47.9 | 847.7 | −6 |
| 30 | 35 | 35 | 45.4 | 841.0 | −9 |
| 35 | 20 | 45 | 46.5 | 848.9 | −7 |
| 35 | 35 | 30 | 44.6 | 843.8 | −9 |
| 40 | 30 | 30 | 44.4 | 848.4 | −8 |
| 40 | 40 | 20 | 43.1 | 845.0 | −10 |
| 50 | 45 | 5 | 40.8 | 849.0 | −10 |
| 50 | 47 | 3 | 40.6 | 848.4 | −10 |
| European specifications | | | >51 | 820-845 | (**) |

(*) measured using IP 498 [IQT]

(**) depends on region and season

The results in Table 1 show that only the first blend containing 15 vol % HLCCO and 85 vol % HDS fulfilled the European requirements relating to density and cetane number. All other blends had a too low cetane number and sometimes even a too high density.

EXAMPLE 1

The blending study of the comparative experiment is repeated except that instead of the refinery kerosene a Fischer-Tropsch kerosene is used having the properties as listed in Table 2. The resultant cetane number, density and CFPP are provided in Table 2. Table 2 also notes the fuel requirements, which make the blend suited for use as Automotive Gas Oil.

TABLE 2

| HLCCO | Fischer-Tropsch derived kerosene | HDS | Cetane number (*) | Density at 15° C. (kg/m$^3$) | CFPP (° C.) |
|---|---|---|---|---|---|
| 100% | | | 38.4 | 892.7 | −2 |
| | 100% | | 64.5 | 742.4 | −48 |
| | | 100% | 54.7 | 835.6 | −5 |
| Blend composition (vol %) | | | Calculated blend properties | | |
| 15 | 0 | 85 | 52.3 | 844.2 | −5 |
| 12 | 25 | 60 | 54.7 | 820.9 | −8 |
| 20 | 5 | 75 | 51.9 | 842.4 | −5 |
| 20 | 25 | 55 | 53.9 | 823.7 | −8 |
| 25 | 10 | 65 | 51.6 | 840.6 | −5 |
| 25 | 30 | 45 | 53.6 | 821.9 | −8 |
| 30 | 15 | 55 | 51.3 | 838.8 | −6 |
| 30 | 35 | 35 | 53.2 | 820.1 | −9 |
| 35 | 20 | 45 | 51 | 836.9 | −7 |
| 35 | 35 | 30 | 52.4 | 823 | −9 |
| 40 | 30 | 30 | 51.1 | 830.5 | −8 |
| 40 | 40 | 20 | 52.1 | 821.1 | −10 |
| 50 | 45 | 5 | 51 | 822.2 | −10 |
| 50 | 47 | 3 | 51.2 | 820.3 | −10 |
| European specifications | | | >51 | 820-845 | (**) |

(*) measured using IP 498 [IQT]

(**) depends on region and season

The results in Table 2 show that it is possible to make blends containing up to 50 vol % HLCCO whilst still meeting the specification. This is a significant improvement compared to the results obtained using conventional refinery blending components.

EXAMPLE 2

For a complete confirmation of this blending approach real laboratory blends and measurements were made to complement the blend modelling. The blending components had the properties as listed in Table 3.

TABLE 3

| | Blending Component | | |
|---|---|---|---|
| | a | b | c |
| Description | Hydrotreated LCCO | Hydrotreated gas oil | Fischer-Tropsch derived kerosene |
| Density at 15° C. (kg/m$^3$) | 892.7 | 835.6 | 742.4 |
| Cetane number | 38.4 | 54.7 | 64.5 |
| CFPP (° C.) | −2 | −5 | −48 |
| Initial boiling point (° C.) | 203.8 | 183.9 | 163.4 |
| T95 wt % boiling point (° C.) | 362 | 348 | 194.9 |
| Sulphur (mg/kg) | 1043 | 59 | <1 |
| Aromatic compounds (wt %) | Total: 53.4 | Total: 23.2 | <0.1 |
| Mono aromatics | 37.2 | 21.1 | |
| Di-aromatics | 12.5 | 1.9 | |
| Tri and higher aromatics | 3.7 | 0.2 | |

Table 4 illustrates the measured properties of the blends. These results illustrate the present invention further.

TABLE 4

| HLCCO | Fischer-Tropsch derived kerosene | HDS | Cetane number | Density at 15° C. (kg/m$^3$) | CFPP (° C.) |
|---|---|---|---|---|---|
| Blend composition (vol %) | | | Blend properties | | |
| 20 | 5 | 75 | 51.1 | 842.4 | −5 |
| 20 | 25 | 55 | 52.6 | 824 | −8 |
| 30 | 15 | 55 | 49.4 | 839 | −6 |
| 30 | 35 | 35 | 51 | 820.6 | −8 |

What is claimed is:

1. An automotive gas oil fuel composition comprising:

(a) a quantity of from greater than 15 vol % to 60 vol % of a cracked gas oil exhibiting a density at 15° C. of greater than 845 kg/m$^3$;

(b) a mineral derived gas oil other than (a);

(c) a quantity of a Fischer-Tropsch derived kerosene fraction having paraffin content of between 98 and 100 wt % effective to produce the fuel composition comprising:

(i) a density at 15° C. of between 820 and 845 kg/m$^3$;

(ii) a cetane number of equal to or greater than 40;

(iii) a T95 of between 275 and 360° C.; and (iv) a cold filter plugging point below +5° C.

2. The fuel composition of claim 1 comprising between 10 and 50 vol % of the Fischer-Tropsch derived kerosene fraction (c).

3. The fuel composition of claim 1 comprising 30 vol. % or more of the cracked gas oil component (a).

4. The fuel composition of claim 1 comprising 40 vol. % or more of the cracked gas oil component (a).

5. The fuel composition of claim 1 comprising 50 vol. % or more of the cracked gas oil component (a).

6. The fuel composition of claim 1 exhibiting a cetane number of above 45.

7. The fuel composition of claim 3 exhibiting cetane number of above 45.

8. The fuel composition of claim 5 exhibiting cetane number of above 45.

9. The fuel composition of claim 1 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

10. The fuel composition of claim 3 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

11. A fuel composition comprising:

(a) from greater than 15 vol. % to 60 vol. % of a cracked gas oil having a density at 15° C. of greater than 845 kg/m$^3$ and a cetane number of less than 45;

(b) an amount of a mineral derived gas oil other than (a), the mineral derived gas oil having a density at 15° C. of between 820 and 845 kg/m$^3$ and a cetane number of from 51 to 75, and (c) a quantity of a Fischer-Tropsch derived kerosene fraction having paraffin content of between 98 and 100 wt %, a density at 15° C. of from 730 to 760 kg/m$^3$ and a cetane number of from 63 to 75, the quantity being sufficient to produce the fuel composition comprising:

(i) a density at 15° C. of between 820 and 845 kg/m$^3$;

(ii) a cetane number of equal or greater than 40

(iii) a T95 of between 275 and 360° C.; and (iv) a cold filter plugging point below +5° C.

12. The fuel composition of claim 11 comprising 30 vol. % or more of the cracked gas oil component (a).

13. The fuel composition of claim 11 comprising 40 vol. % or more of the cracked gas oil component (a).

14. The fuel composition of claim 11 comprising 50 vol. % or more of the cracked gas oil component (a).

15. The fuel composition of claim 11 wherein the quantity of Fischer-Tropsch derived kerosene fraction is sufficient to produce a cetane number of above 45.

16. The fuel composition of claim 12 wherein the quantity of Fischer-Tropsch derived kerosene fraction is sufficient to produce a cetane number of above 45.

17. The fuel composition of claim 14 wherein the quantity of Fischer-Tropsch derived kerosene fraction is sufficient to produce a cetane number of above 45.

18. The fuel composition of claim 11 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

19. The fuel composition of claim 12 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

20. The fuel composition of claim 13 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

21. A process for increasing the amount of cracked gas oil that can be included in an automotive gas oil fuel composition having a density at 15° C. of between 820 and 845 kg/m$^3$, a T95 of between 275 and 360° C., a cold filter plugging point below +5° C., and a cetane number of equal or greater than 40, the process comprising:

blending (a) from greater than 15 vol. % to about 60 vol % cracked gas oil having a density at 15° C. of greater than 845 kg/m$^3$ and a cetane number of less than 45, with (b) mineral derived gas oil other than the cracked gas oil (a), the mineral derived gas oil having a cetane number of from greater than 45 to about 80, and (c) a quantity of Fischer-Tropsch derived kerosene fraction having a density at 15° C. of from 730 to 760 kg/m$^3$ and a cetane number of from 63 to 75 and paraffin content of between 98 and 100 wt %;

wherein the quantity of the Fischer-Tropsch derived kerosene fraction is sufficient to produce the fuel composition having a density at 15° C. of between 820 and 845 kg/m$^3$ and a cetane number of equal or greater than 40.

22. The process of claim 21 comprising blending 30 vol. % or more of the cracked gas oil (a).

23. The process of claim 21 comprising blending 40 vol % or more of the cracked gas oil (a).

24. The process of claim 21 comprising blending 50 vol % or more of the cracked gas oil (a).

25. The process of claim 21 wherein the quantity of the Fischer-Tropsch derived kerosene fraction (c) is sufficient to produce the fuel composition having a cetane number of above 45.

26. The process of claim 22 wherein the quantity of the Fischer-Tropsch derived kerosene fraction (c) is sufficient to produce the fuel composition having a cetane number of above 45.

27. The process of claim 23 wherein the quantity of the Fischer-Tropsch derived kerosene fraction (c) is sufficient to produce the fuel composition having a cetane number of above 45.

28. The process of claim 21 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

29. The process of claim 22 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

30. The process of claim 23 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

31. An automotive gas oil fuel composition comprising:

(a) from greater than 15 vol % to about 60 vol % hydrotreated light cycle oil;

(b) ultra low sulfur diesel fuel; and, (c) a quantity of a Fischer-Tropsch derived kerosene fraction having paraffin content of between 98 and 100 wt % sufficient to produce the fuel composition having a density at 15° C. of between 820 and 845 kg/m$^3$ and a cetane number of equal to or greater than 40 and T95 of between 275 and 360° C., a cold filter plugging point below +5° C.

32. The fuel composition of claim 31 comprising 30 vol. % or more of the hydrotreated light cycle oil (a).

33. The fuel composition of claim 31 comprising 40 vol. % or more of the hydrotreated light cycle oil (a).

34. The fuel composition of claim 31 comprising 50 vol. % or more of the hydrotreated light cycle oil (a).

35. The fuel composition of claim 31 wherein the fuel composition has a cetane number of above 45.

36. The fuel composition of claim 32 wherein the fuel composition has a cetane number of above 45.

37. The fuel composition of claim 33 wherein the fuel composition has a cetane number of above 45.

38. The fuel composition of claim 31 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

39. The fuel composition of claim 32 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

40. The fuel composition of claim 33 wherein operating an automotive vehicle using the fuel composition comprising a refinery kerosene fraction in place of the Fischer-Tropsch derived kerosene fraction produces a first acceleration time; and, operating the automotive vehicle under the same conditions using the fuel composition comprising the Fischer-Tropsch derived kerosene fraction produces an improved acceleration time.

* * * * *